US005373584A

United States Patent [19]

Parcells, III

[11] Patent Number: 5,373,584

[45] Date of Patent: Dec. 20, 1994

[54] SLIDING ACCESSORIES TO PERMIT IN-LINE ROLLER SKATING MANEUVERS EQUIVALENT TO ICE SKATING MANEUVERS

[76] Inventor: Charles A. Parcells, III, 1167 Lakepointe, Grosse Pointe Park, Mich. 48230

[21] Appl. No.: 20,196

[22] Filed: Feb. 19, 1993

[51] Int. Cl.[5] ..... A41D 13/00

[52] U.S. Cl. ..... 2/2; 2/23; 2/24; 2/160; 2/908; 280/811

[58] Field of Search ..... 2/2, 16, 20, 22, 23, 2/24, 46, 62, 160, 161 R, 161 A, DIG. 6, 44, 45, 908, 909, 910, 911, 159, 161.1, 163, 1; 602/26; 280/811, 809

[56] References Cited

U.S. PATENT DOCUMENTS

| | | | |
|---|---|---|---|
| 1,577,540 | 3/1926 | Punches | 2/16 |
| 3,322,873 | 5/1967 | Hitchcock | 2/24 |
| 3,945,042 | 3/1976 | Lobo | 2/2 |
| 3,991,420 | 11/1976 | Savarino | 2/2 |
| 4,071,913 | 2/1978 | Rector | 2/20 |
| 4,317,237 | 3/1982 | Porte | 2/2 |
| 4,561,123 | 12/1985 | Hull | 2/16 |
| 4,599,747 | 7/1986 | Robinson | 2/24 |
| 4,641,641 | 2/1987 | Strock | 2/2 |
| 4,688,269 | 8/1987 | Maeshima | 2/2 |
| 4,700,403 | 10/1987 | Vacanti | 2/22 |
| 4,930,162 | 6/1990 | Cote | 2/16 |
| 5,070,545 | 12/1991 | Tapia | 2/195 |
| 5,095,547 | 3/1992 | Kerns | 2/160 |
| 5,220,691 | 6/1993 | Wiegers | 2/24 |
| 5,234,230 | 8/1993 | Crane et al. | 280/811 |

*Primary Examiner*—Clifford D. Crowder
*Assistant Examiner*—Michael A. Neas
*Attorney, Agent, or Firm*—James M. Deimen

[57] ABSTRACT

To provide effective and protective sliding means for in-line roller skating, ultra-high molecular weight polyethylene (UHMW) plates are detachably fastened to the protective outerclothes and gloves of the user. Hook and loop fasteners are used in a manner that permits the UHMW plates to articulate on the fastening as the plate slides or skids on the pavement and the user's position changes during the slide. With the hook and loop fastening, excessive shear stress or pulling, from contact with an obstruction, permits the UHMW plate to separate before these stresses damage the skid plate, the hook and loop fastening, the adhesive bonds or the underlying protective clothing. The result is a slide or sliding fall as on ice in ice skating and various fall and slide maneuvers of the ice skater are made practical for the in-line roller skater on pavement.

10 Claims, 3 Drawing Sheets

SLIDING ACCESSORIES TO PERMIT IN-LINE ROLLER SKATING MANEUVERS EQUIVALENT TO ICE SKATING MANEUVERS

BACKGROUND OF THE INVENTION

The field of the invention pertains to roller skating and, in particular, to accessories for serious in-line roller skating activities. In-line roller skates comprise skates having a plurality of wheels (usually four) mounted one behind the other in the nature of a blade analogous to ice skate blades.

In-line roller skating has become increasingly popular in recent years in part because in-line skates are well suited to outdoor skating on pavement and much more maneuverable than two by two roller skates. Thus, in-line roller skates can be skated more like ice skates and similar speeds attained on relatively smooth pavements. As a result, activities common on ice are now being attempted on concrete, asphalt and other pavements.

Contact at speed with most pavements causes effects generally much more severe than contact with ice. Primarily, contact at speed of the hand, hip or knee, whether accidental or purposeful, stops the vertical component of motion almost instantaneously whether on ice or pavement, however, on ice the innate slippery surface permits the horizontal component of motion to continue almost unabated. Thus, ice skaters, figure skaters and hockey players take many falls and only rarely undergo serious injury. Figure skaters and hockey players are specifically coached on proper falling techniques and may practice these techniques to avoid injury.

However, most pavements are not so forgiving. With the purposefully non-slippery surface of most pavements, the horizontal component of motion is brought to a halt by high friction almost as quickly as the vertical component. Thus, injury or significant damage to clothing is substantially more likely with falls in in-line roller skating and, even with protective equipment such as the gloves of hockey players, falls on pavement are rarely purposely practiced. For instance, hockey clothing and gloves can protect against some injury by the pavement, in particular, severe abrasions and bruising, however, the sudden horizontal halt can cause severe damage to joints, bones, tendons and muscles that wouldn't likely occur with a similar fall on ice. With multiple falls traditional hockey clothing and gloves may be ruined unacceptably fast.

If purposeful falling techniques are attempted and practiced in conventional hockey clothing and gloves, or other traditional in-line skate protective gear, the cloth is quickly abraded and shredded by the pavement. In an attempt to overcome the effects of abrasion somewhat, "cap-shaped" knee pads of molded nylon, polyethylene or ABS plastic are riveted or sewn to the clothing to protect both the knees and the clothing. With a number of falls these hard knee pads become severely abraded and the permanent fastenings (rivets and stitching) tend to tear loose, substantially destroying the usefulness of the protective garment.

A device typically called "wrist guards" is currently offered to in-line roller skaters. These comprise a cloth band about the wrist with a piece of curved hard plastic attached under the wrist generally extending over the heel of the hand. Such wrist protectors splint the wrist with a second hard piece atop the wrist preventing full freedom of movement of the hand.

Some individuals have experimented with gloves having a large piece of polycarbonate plastic permanently attached to the palm of the hand. The hard and tough polycarbonate plastic provides significantly greater protection from abrasion than the normal leather or cloth palm. However, plastic plates permanently fastened to the palms and of sufficient size to protect the gloves and hands against sliding abrasion make the gloves difficult to remove and greatly interfere with grip if not removed. Moreover, the positions of the plates on the gloves cannot be altered because of the permanent attachment. These hand protection devices are relatively heavy, and because they are so cumbersome, are not practical for use by in-line skaters.

The applicant, having been confronted with the almost total lack of any accessories suitable for accidental or purposeful sliding on pavement by in-line skaters, has developed performance enhancing accessories as described below to permit aggressive in-line roller skating and aggressive in-line street hockey playing with more of the speeds, thrills and falls of ice hockey and tournament skating.

SUMMARY OF THE INVENTION

The invention comprises several sliding accessories attachable to the protective clothing and gloves of an in-line roller skater. The accessories comprise both flat and curved plates of ultra-high molecular weight polyethylene (UHMW) detachably fastened to the clothing and gloves. The detachable fastening for the UHMW plates comprises hook and loop fasteners (Velcro TM for example). Hook and loop fasteners are well known for attaching a variety of items to clothing and gloves, however, the applicant has discovered that three unobvious attributes of hook and loop fasteners are critical to the outstanding success of the use of UHMW plates as sliding accessories for in-line roller skating.

The superior "slipperiness" and resistance to abrasion of the UHMW plates, in combination with the detachable nature of hook and loop fasteners, permits accidental and purposeful falls and slides of ice skating to be performed in in-line roller skating on concrete and asphalt with the comparable relative safety of ice skating and at a lower cost per maneuver when compared to the use of traditional protective gear. The applicant subscribes to the idea that it contributes more to a skater's safety to practice landing rather than simply avoid crashes. The sliding equipment disclosed below is designed to make "landing practice" feasible and cost effective.

Counter-intuitively the detachable nature of hook and loop fastened UHMW plates permit the UHMW plates to "move around" or articulate on the attachment in response to both the unevenness of the pavement and the constantly changing position of the wearer whether it be his knee, his hip, his hand or his skate boot that is bearing his weight in contact with the pavement. In effect, the wearer is sliding on pavement as if sliding on ice. The invention permits in-line "street hockey" (preferably played in an empty parking lot) to be played closer to the same speed, intensity, vigor and excitement of ice hockey with less damage to the player's underlying clothing and protective equipment.

The three critical but unobvious aspects of the hook and loop attachment of the UHMW plates are, firstly, a differing curvature between the UHMW plate equipped with one part of the fastener glued on and the underlying element of clothing having the complementary fastener sewn or glued on. Thus, the UHMW plate purposely does not fully and completely attach, but rather is free to articulate on the attachment with portions detaching as other portions are attaching or re-attaching under stress conditions.

Secondly, hook and loop fasteners facilitate the use of flat bottomed UHMW "skid plates". Hook and loop fasteners attached by adhesive means to the "skid plate" are degraded in the manner rivets, stitching or other through fastening devices are by abrasion on pavement. UHMW, being the most cost effective material presently available for the practice of sliding maneuvers, but having the quality of a waxy surface that makes glue bonds weak, necessitates the "give" or release of hook and loop detachment and re-attachment. This combination of elements preserves the integrity of the glue bond as well as the underlying garment worn by the user.

And, thirdly, the UHMW plate can, under sufficient stress, completely detach from the skater. Detachment is desirable to minimize damage to the underlying element of clothing and to the adhesive holding the fastener to the UHMW plate. Events of exceptionally high stress occur when the sliding UHMW plate encounters a break in the pavement or otherwise catches on some obstruction or stationary object. As a general rule, it does not contribute to a skater's safety to be caught by his or her equipment on a stationary object.

Although leisurely in-line roller skating is performed at about 3 to 11 or 12 miles per hour, speeds of 20 to 30 miles per hour are attainable on level pavement (and anything one dares on a slope). Applicant is an accomplished in-line skater and now repeatedly practices slides and falls on pavement. To test the knee pad slider assembly more fully described below, the applicant took more than five hundred sliding falls on the same UHMW plate knee slider plate without damage to the hook and loop fastening or to himself. The UHMW plate, originally ⅜" thick was fully capable of accepting another 500 or more slides before losing one half its thickness and strength.

Other advantages to the new sliding accessories are more fully detailed in the preferred embodiments below. Although described above and below in terms of UHMW plates, plates of plastics with similar "slipperiness", strength and abrasion resistance might be used.

DESCRIPTION OF THE PREFERRED EMBODIMENTS

Figure 1:
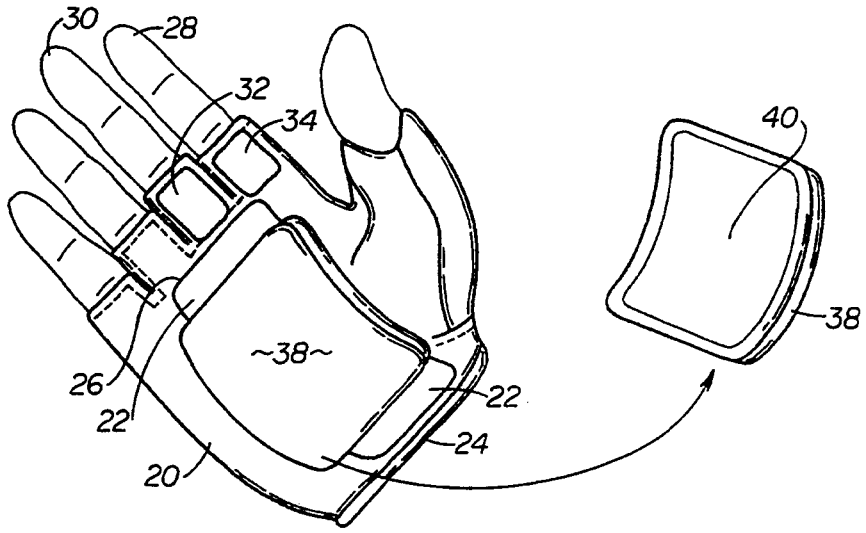
FIG. 1 is a perspective view of a right hand fingerless glove and palm plate.
Figure 2:
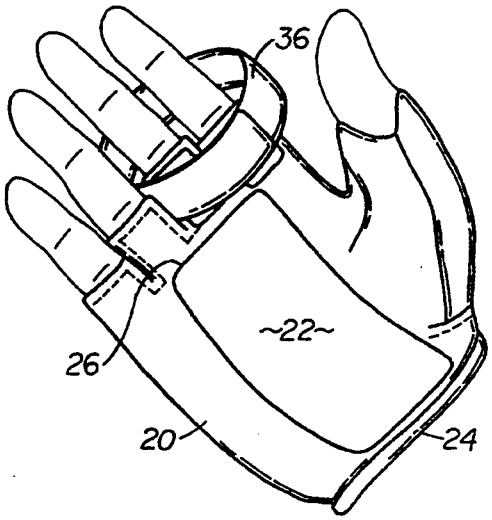
FIG. 2 is a perspective view of the fingerless glove with a thumb ring or grab loop but absent the palm plate.
Figure 3:
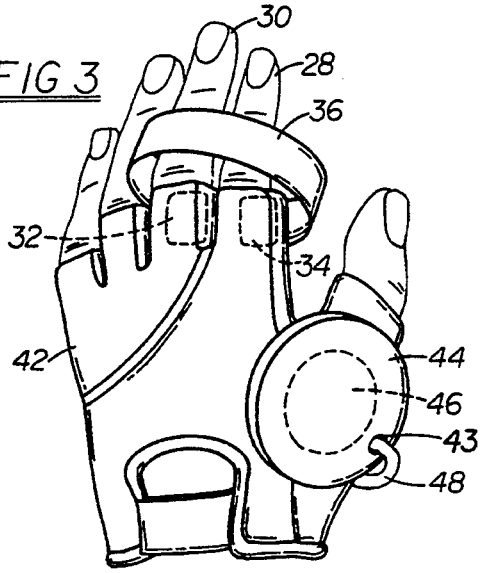
FIG. 3 is a perspective view of a left hand fingerless glove from the back side with a mirror attached.

Illustrated in FIGS. 1 and 2 is a fingerless right glove 20 equipped for in-line roller skating maneuvers. Although illustrated for the left hand, the right hand glove in FIG. 3 is similarly equipped. A relatively large patch 22 of one of the complementary halves of a hook and loop fastener is sewn to the palm of the glove 20. The patch extends from the wrist 24 to the roots of the fingers at 26.

Between the first and second joints of the index 28 and middle 30 fingers are a pair of patches 32 and 34 of hook and loop fastener sewn to the glove 20. The pair of patches 32 and 34 permit attachment of a cloth grab loop 36 very loosely about the fingers 28 and 30. The grab loop 36 includes a hook and loop fastener inside the loop and complementary to patches 32 and 34.

A curved palm plate 38 of ultra-high molecular weight (UHMW) polyethylene is equipped with hook and loop fastener 40 complementary to the palm patch 22. The hook and loop fastener 40 is preferably permanently glued to the back side of the UHMW plate 38. The palm plate 38 may be positioned as desired for most comfortable fit on the patch 22. Through extensive testing the palm plate 38 has proven to remain attached despite sudden purposeful or accidental impact with the pavement at high skating speed. Nevertheless, the palm plate 38 may be easily removed leaving the glove 20 and hand free for grasping. The palm plate 38 also will peel off quickly in the event the plate is caught by a door handle or an obstruction while sliding. No rivets or stitching pass through the palm plate 38 nor are any special pockets in the glove 20 required.

In FIG. 3 the left glove 42 is shown from the back side equipped with a mirror 44 on the glove. A pair of complementary hook and loop fasteners 46 are sewn to the glove 42 over the thumb metacarpal bone and glued to the underside of the mirror. A small strap 48 or string lanyard passes through a hole 43 in the mirror 44 and rests between the palm patch 22 and the fastener 40 on the palm plate 38 to retain the mirror in the event the mirror is knocked loose. Between the first and second joints of the index 28 and middle 30 fingers are also a pair of patches 32 and 34 of hook and loop fastener sewn to the glove 42. A grab loop 36 may be placed on the left glove 42 as shown as an alternative. Thus, the grab loop 36 may be used on either glove as desired by the skater.

Figure 4:
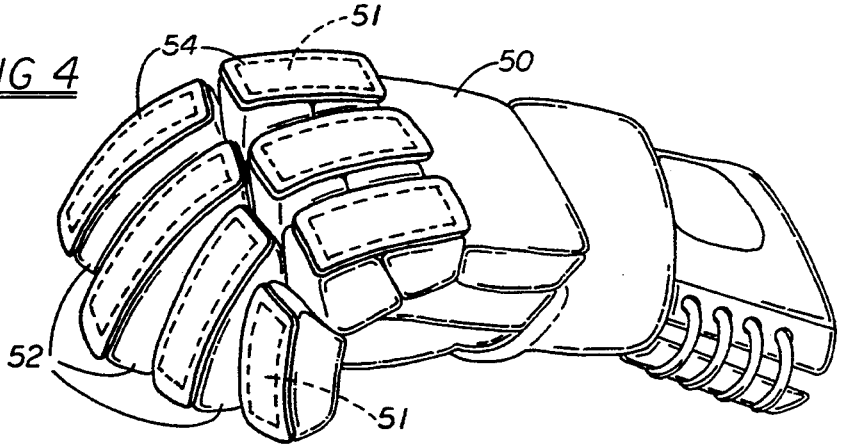
FIG. 4 is a perspective view of a hockey glove equipped for street hockey.

FIG. 4 illustrates a street hockey player's glove 50 as distinguished from the roller skater's glove of FIGS. 1 through 3. The hockey glove is full fingered and much like an ice hockey glove with the exception of the protective UHMW plates added for abrasion protection. An ice hockey glove is quickly shredded by abrasion under street hockey use absent the UHMW plates. To prevent shredding of the gloves and damage to the fingers, the fingers 52 are each protected by gently curved UHMW plates 54 fastened by hook and loop fasteners 51 sewn to the glove fingers and glued to the plates respectively. Thus, just as falls onto the fingers and knuckles with the hockey stick tightly grasped are common in ice hockey, the fingers and knuckles in street hockey may make contact with the pavement.

As above the UHMW plates 54 can be adjustably positioned on the fingers 52 to meet the requirements of the hockey player for comfort and grip. And in the event of inadvertent snagging the plates 54 will detach preventing damage to the glove 50 or plates 54 and lessening the likelihood of injury to the hockey player. The hockey glove 50 may be equipped with the palm plate 38 and palm patch 22, however, for most players the palm plate may be positioned closer to the wrist to provide sufficient clearance for a suitable grip of the hockey stick.

Figure 5:
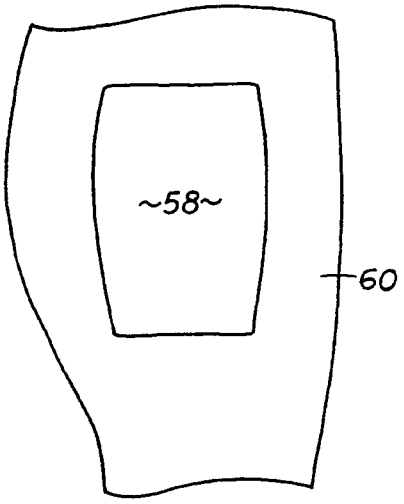
FIG. 5 is a partial side view of tights with fasteners sewn in place for a hip guard.
Figure 6:
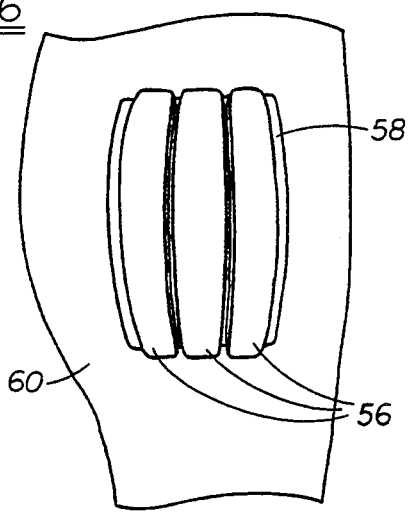
FIG. 6 illustrates the hip guard plate positioned on the tights.

Illustrated in FIGS. 5 and 6 are hip plates 56 again attached by hook and loop fastening means 58 to tights or pants 60. The hip plates 56 are relatively long slightly curved strips of UHMW about one-sixteenth inches in thickness. The hip plates 56 are generally curved to better fit over the hip area of the wearer. The hook and loop fastening means permits the hip plates to detach if snagged during sliding as above, thus enabling the skater to maneuver very close to the pavement in reasonable safety analogous to an ice skater. Hereagain the lack of rivets or other permanent attachment of the hip plates 56 is of great advantage.

Figure 7:
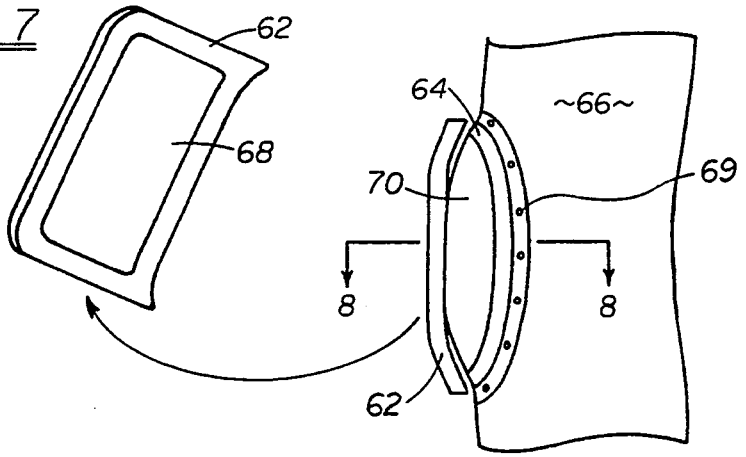
FIG. 7 is a side view of a knee slider plate attachable to a knee cup.
Figure 8:
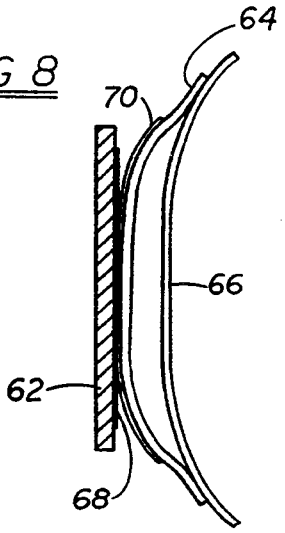
FIG. 8 is a partial cross-section taken along the line 8—8 in FIG. 7.

FIGS. 7 and 8 illustrate to great advantage the combination of a substantially flat UHMW knee pad or skid plate 62 hook and loop fastened to a conventional knee cup 64 of the skater's tights or pants 66. The complementary hook and loop fastener parts are glued 68 to the inside of the knee pad 62 and glued 70 to the compound curved outer surface of the knee cup 64. The knee cup 64 in turn is permanently attached by stitching or rivets 69 to the pants or tights 66. As shown, only a relatively small portion of the hook and loop fastener 68, 70 attaches the knee pad 62 to the knee cup 64, however, the knee pad 62 can rock about the knee cup 64 by automatically detaching and simultaneously attaching at various portions of the hook and loop fastener 68, 70 to provide a sliding surface contacting the pavement.

Regardless of how the skater lands on and slides on his or her knees, the knee pad 62 rocks about the knee cup 64 to provide an even sliding surface on the pavement. Thus, the knee pad 62 self-aligns as necessary to provide a smooth sliding action. As above, inadvertent snagging by a pavement break or other obstruction may cause the hook and loop fastener between the knee cup 64 and knee pad 62 to shear loose without damage to the knee pad 62 or the knee cup 64 and tights or pants 66. Applicant has tested UHMW knee pads or slider plates three-eighths inches in thickness. The result was less than 50% wear in over 500 sliding falls and no failure of the knee pads 62 or hook and loop fasteners 68, 70.

In all of the embodiments above of the UHMW plate, the plate can shift position as required because of the hook and loop fastener. The ability to shift position as required by the pavement enables the UHMW plate to slide on the pavement smoothly and simulate sliding on ice. The ability to shift position of the fastening means is most pronounced and effective with respect to the substantially flat knee pad 62 above. Permanent fastening with rivets or stitching of the knee pad 62 would obviously be detrimental.

Figure 9:
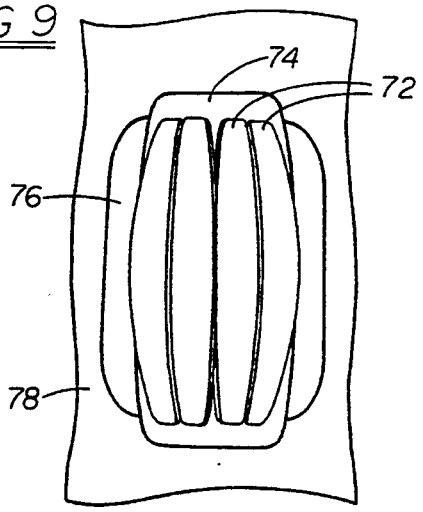
FIG. 9 is a front view of a multiple curved plate knee guard.

In FIG. 9 an alternate form of knee pad or slide assembly 72 is illustrated. The knee pad 72 comprises a plurality of substantially curved vertical UHMW plates attached by hook and loop fastener underneath each plate and complementary hook and loop fastener 74 attached to the knee cup 66 or to the underlying garment. The separate plates 72 can move separately on the fastener 74 to accommodate a slide. However, the alternate form of knee pad 72 in FIG. 9 is more attractive in appearance on the tights or pants 78 and lighter in weight for a (speed) skater willing to give up some protection for a lighter weight device.

Figure 10:
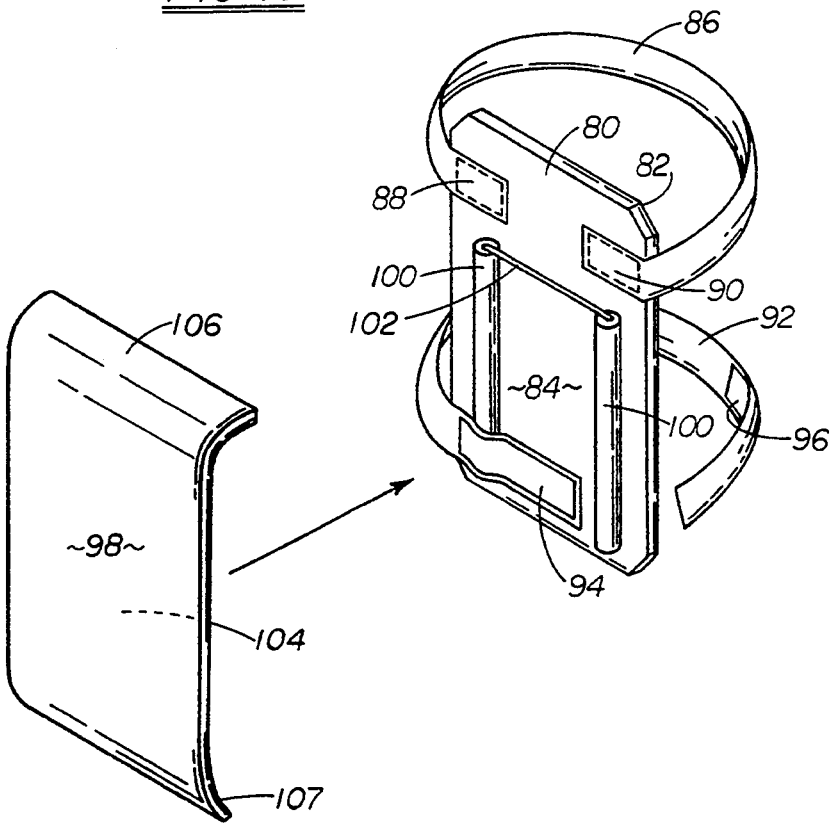
FIG. 10 is an exploded perspective view of an attachable knee slider plate assembly.

FIG. 10 illustrates a knee slider assembly that does not incorporate direct attachment to the tights or pants. A semi-rigid plastic backing plate or shin cushion 80 comprises a layer approximately three-eighth inches in thickness of stiff foam padding on the back side 82 and hook and loop fastener 84 on the entire front side. An elastic strap 86 is fastened with complementary hook and loop fastener at 88 and 90 adjacent the top of the shin cushion 80. A second strap, the "smart strap", 92 of substantially non-elastic material includes hook and loop fastener 94 and complementary part 96 on the underside of the other end. The "smart strap" 92 is not permanently attached to the shin cushion 80 but rather is trapped by the attachment of the UHMW knee pad or skid plate 98 which covers and protects the "smart strap" from abrasion or pavement.

Two tubes 100 of substantially non-elastic material are connected together at one end by a relatively inelastic cord 102 and are covered with hook and loop fastener complementary to the fastener 84. The cord 102 prevents the tubes 100 from migrating off the shin cushion 80 at the top. The backside 104 of the UHMW skid plate 98 is covered with hook and loop fastener complementary to the fastener on the tubes 100. Thus, the skid plate 98 attaches to the tubes 100 in turn attached to the backing plate 80. The tubes 100, sandwiched between the shin cushion 80 and the "smart strap" 92 and then covered by the skid plate 98 add stiffening strength to the shin cushion. The upper end of the skid plate 98 is substantially curved as indicated at 106 to protect the knee cap. The lower end 107 of the skid plate 98 is also curved thereby trapping the "smart strap" 92 when the strap 92 is attached about the leg just behind the knee and the strap ends are connected together and positioned over the tubes 100 behind the skid plate.

In the embodiment of FIG. 10 the skid plate 98 is free to roll on the tubes 100 and thereby adjust position on the shin cushion 80 within the limits of the shin cushion. The wrapped around lower "smart strap" 92, being fastened over the tubes 100 prevents the tubes from rolling off the edges of the shin cushion 80 at the lower end.

In use the lower non-elastic "smart strap" 92 fits over the upper part of the calf muscle to provide the proper vertical position for the skid plate 98 and shin cushion 80. The elastic strap 86 fits thereabove behind the knee and is optional. Because the non-elastic "smart strap" 92 fits over the upper part of the calf muscle, the knee slider assembly is prevented from moving down the calf from the knee area in normal use. The tubes 100 impart rigidity to the shin cushion 80 to raise the threshold before the shin cushion and skid plate 98 are forced to move down the shin under sliding action. The limited area of skid plate 98 attachment to the tubes 100 allows break away of the skid plate 98 if an obstruction is encountered. Thus, the knee slider assembly acts to accommodate increasing stages of resistance in a pavement slide. The sliding device of FIG. 10 is lighter, cooler, more durable and generally higher in performance than traditional in-line knee protectors.

Figure 11:
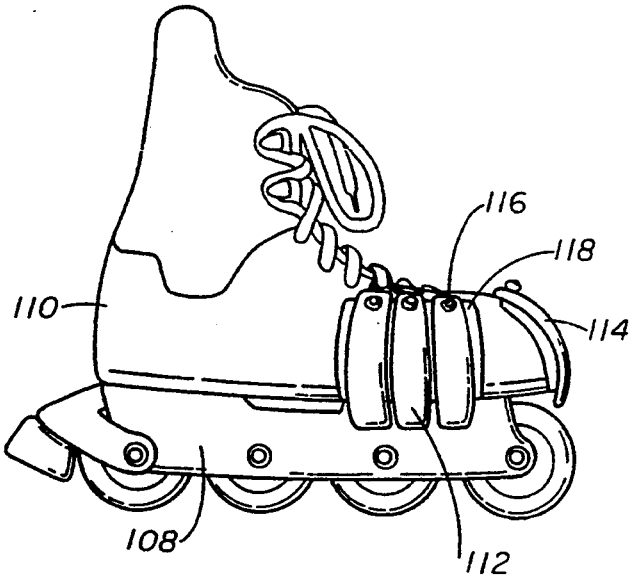
FIG. 11 is a side view of a roller skate with toe and inside curved plate guards.
Figure 12:
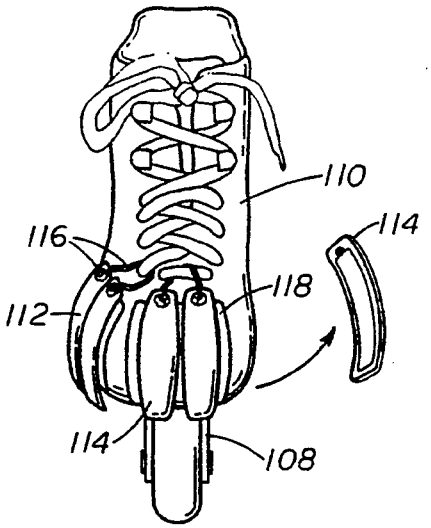
FIG. 12 is a front view of the roller skate of FIG. 11.

FIGS. 11 and 12 illustrate an in-line roller skate having a wheeled "blade" 108 and a boot 110 thereattached. The roller skate is equipped as shown with a plurality of curved UHMW plates on the outside side 112 and on the toe 114. The curved UHMW plates are each attached with a slight amount of tension at the top as shown at 116 by string lanyards to the boot laces. Beneath the UHMW plates 112 and 114 are hook and loop fasteners 118 as above and therefore the plates are free to move and twist to a limited extent as necessary when in contact with pavement. In the event the UHMW plates 112 and 114 are pulled loose, the string lanyards 116 prevent the plates from being lost in the slide on the pavement. Despite being constructed of tough abrasion resistant materials, the boots nevertheless need the additional protection from repeated abrasion in practice falls and slides. Otherwise the boots are scuffed and torn through long before 500 practice slides are completed.

I claim:

1. A protective knee slider assembly comprising a shin cushion having a front and back, a first portion of a hook and loop fastener means covering the front of the shin cushion, a pair of tubes covered with complementary hook and loop fastener means, a tough highly abrasion resistant plastic skid plate, a backside on the skid plate, additional first portion of the hook and loop fastener means attached to the backside of the skid plate, and a separate inelastic strap attachable about the shin cushion and pair of tubes, said tubes being attached to the front of the shin cushion, said inelastic strap extending over the tubes and around the back of the shin cushion and said skid plate having the backside thereof attached to the tubes trapping the inelastic strap thereunder, whereby with the inelastic strap fastened over the upper part of the calf muscle of the user, the knee slider assembly can move down the shin under sufficient sliding force applied to the skid plate and the skid plate can separate from the assembly with sufficient additional sliding force.

2. The protective knee slider assembly of claim 1 wherein the skid plate comprises a substantially flat ultra-high-molecular-weight-polyethelene plate having at least the lower end thereof curved to retain the inelastic strap thereabove.

3. A protective knee slider assembly comprising a shin cushion having a front and back, a first portion of a hook and loop fastener means covering the front of the shin cushion, a pair of stiffening means extending vertically on the shin cushion, a tough highly abrasion resistant plastic skid plate, a backside on the skid plate, complementary hook and loop fastener means attached to the backside of the skid plate, and a separate inelastic strap attachable about the shin cushion and stiffening means, said inelastic strap extending around the back of the shin cushion and said skid plate having the backside thereof attached to the shin cushion trapping the inelastic strap thereunder, whereby with the inelastic strap fastened over the upper part of the calf muscle of the user, the knee slider assembly can move down the shin under sufficient sliding force applied to the skid plate and the skid plate can separate from the assembly with sufficient additional sliding force.

4. The protective knee slider assembly of claim 3 wherein the skid plate comprises a substantially flat ultra-high-molecular-weight-polyethylene plate having at least the lower end thereof curved to retain the inelastic strap thereabove.

5. A garment and protective sliding accessory combination comprising at least one detachable tough highly abrasion resistant plastic plate, an underside on the plate, hook and loop fastener means having a first portion affixed to the underside of the plate and or complementary portion affixed to a surface of the garment, said surface of the garment and complementary portion of the fastener means having a curvature substantially differing from the curvature of the underside of the plate and first portion of the fastener means whereby the plate can articulate on the garment in response to sliding forces on the plate.

6. The garment and protective sliding accessory of claim 5 wherein the plate comprises a substantially flat plate of ultra-high-molecular-weight polyethylene and the surface of the garment comprises a substantially hard cupped knee pad.

7. The garment and protective sliding accessory of claim 5 wherein the plate comprises a plurality of parallel vertical curved ultra-high-molecular-weight polyethylene plates.

8. The garment and protective sliding accessory of claim 5 wherein the plate comprises a gently curved ultra-high-molecular-weight polyethylene palm plate and the complementary portion of the hook and loop fastener means is substantially larger than the palm plate.

9. The garment and protective sliding accessory of claim 5 wherein the plate comprises a plurality of gently curved ultra-high-molecular-weight polyethylene plates and the surface of the garment comprises the top surfaces of the fingers of a hockey glove.

10. The garment and protective sliding accessory of claim 5 wherein the plate comprises a plurality of cuffed ultra-high-molecular-weight polyethylene plates in parallel placement and the surface of the garment comprises the hip portion of the garment.

* * * * *